US005615863A

United States Patent [19]

Bailey

[11] Patent Number: 5,615,863

[45] Date of Patent: Apr. 1, 1997

[54] DANDY JACK

[76] Inventor: Bobby G. Bailey, P.O. Box 591, Sneads, Fla. 32460

[21] Appl. No.: 430,927

[22] Filed: Apr. 24, 1995

[51] Int. Cl.[6] ..... B66F 7/22

[52] U.S. Cl. ..... 254/94

[58] Field of Search ..... 254/94, 422; 188/32, 188/36

[56] References Cited

U.S. PATENT DOCUMENTS

| | | | |
|---|---|---|---|
| 1,549,479 | 8/1925 | Flower | 254/94 |
| 1,805,508 | 11/1930 | Angelillo . | |
| 3,298,665 | 1/1967 | Sielaff . | |

FOREIGN PATENT DOCUMENTS

| | | | |
|---|---|---|---|
| 484521 | 5/1938 | United Kingdom | 254/94 |

*Primary Examiner*—Robert C. Watson
*Attorney, Agent, or Firm*—Carnes, Cona and Dixon

[57] ABSTRACT

The present invention provides for a jack device that will easily and quickly elevate a vehicle. The jack of the present invention is unitized to provide for the structure to be one piece and consists of a main arcuate member having a first end and a second end. A semi-circular pivot is located and the second end and includes a stop that extends upwardly from the pivot. This semi-circular pivot will receive an axle of a conventional vehicle while the stop maintains the axle within the pivot. An edge or handle extends from the pivot to the second end of the arcuate member. Flanges are attached perpendicularly on the semi-circular pivot, main arcuate member and the edge. The flange attached to the arcuate member increases in width from the first end to the second end. The second end is flat and provide for it to act as a stop.

13 Claims, 5 Drawing Sheets

DANDY JACK

BACKGROUND OF THE INVENTION

1. Field of the Invention

The present invention relates generally to a vehicle jack device and more particularly to a vehicle jack that is efficient, durable and simple in design.

2. Description of the Prior Art

Efforts have been made to provide for a jack device that will easily and quickly lift vehicle trailers or the like. Such a device is disclosed in U.S. Pat. No. 3,298,665 issue to Sieloff. Sieloff discloses a one-piece jack that includes an arcuately shape support member. The arcuately shape support member include a first end and a second end. A semicircular pivot support socket, which is adapted to receive an axle of a vehicle trailer, is located at the first end of the support member. An elongated flange extends from the semicircular pivot socket to the second end of the arcuate base member. Though efficient, this jack does suffer from several shortcomings. First of all, the jack is not designed to accommodate various heights of vehicles (wheel diameters), hence not optimizing the lifting distance. Sieloff is silent for disclosing a means for accommodating various types, styles and model trailers. Additionally, Sieloff does not disclose a stop means for the semi-circular pivot. If the jack of Sieloff is used, there exists a chance for the axle to slip once it is in placed due to the lack of a stopping or holding mechanism. Further, Sieloff does not disclose or make obvious a means providing a stable position once the vehicle is lifted. This lack of stability can be dangerous for the individuals lifting the vehicle, by rending a possibility of the jack slipping and falling over, inherently causing the vehicle to drop.

Another jack is disclosed in U.S. Pat. No. 1,805,508 issue to Angelillo. This vehicle jack includes a curved base member and an elongated shaft that extends upwardly from the curved base. This shaft includes a plurality of openings that are adapted to receive a curved hook and rigid pin. This curved hook is adapted to receive an axle of a vehicle. Due to the series of openings, the pins may be entered at different heights relative to the base, thereby enabling the jack to accommodate a variety of wheel diameters. The use of the pin and hook provides for a device that is cumbersome to use. The use of the pins being adapted to be removably inserted into the opening increases the chances of losing the components.

None of these previous efforts, however, provide the benefits intended with the present invention, such as providing a jack device that is unibody, sturdy, and simple to use. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a jack device that will easily and quickly elevate a vehicle. The jack of the present invention is unitized to provide for the structure to be one piece and consists of a main arcuate base having a first end and a second end.

In the first embodiment of the present invention, the first end is equipped with a first a semi-circular pivot point. This first semi-circular pivot point has distal points to provide for one distal point to contact the first end. Additionally, this semi-circular pivot point receives the axle of a vehicle.

Extending from the opposite distal point to the second end of the arcuate base is a flat first edge. Located perpendicularly on the periphery of the arcuate base, semi-circular pivot point and the flat first edge is a flange. This flange increases in width from the first point to the second point of the arcuate base.

To provide for additional strength for the jack are a plurality of supports. These supports extend from the flange located in the area of the semi-circular region to the flange located on the arcuate base.

The second embodiment of the present invention includes a first semi-circular pivot point. This first semi-circular pivot point has distal points to provide for one distal point to contact the first end. A second semi-circular pivot point is located at the second distal end of the first semi-circular pivot point. This will provide for the second semi-circular pivot point to be located under the first semi-circular pivot point. A stop extends from the second end of the arcuate base member and to the second distal end of the second semi-circular pivot point.

In order to operate the jack of the first or second embodiment of the present invention, the first or second semi-circular pivot is placed on the axle of the vehicle (dependent to the diameter of the tires). This will provide for the distance between the semi-circular pivot to the edge of the arcuate base to be at its lowest length. As the vehicle is moved forward, the arcuate base travels to render the semi-circular pivot to be at its highest length from the edge of the arcuate base, inherently elevating the vehicle from the ground.

Accordingly, it is the object of the present invention to provide for the an easy, lightweight, compact, one piece jack that will quickly and efficiently lift a vehicle trailer.

It is yet another object of the present invention to provide for a jack that will safely maintain a vehicle in an elevated and stable position.

Still another object of the present invention is to provide for a jack that will accommodate a variety of common and conventional wheels of various diameters.

A final object of the present invention, to be specifically enumerated herein, is to provide a jack device in accordance with the proceeding objects and which will conform to conventional forms of manufacture, be of simple construction and easy to use so as to provide a device that would be economically feasible, long lasting and relatively trouble free in operation.

Although there have been many inventions related to jacks used with vehicle trailers, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
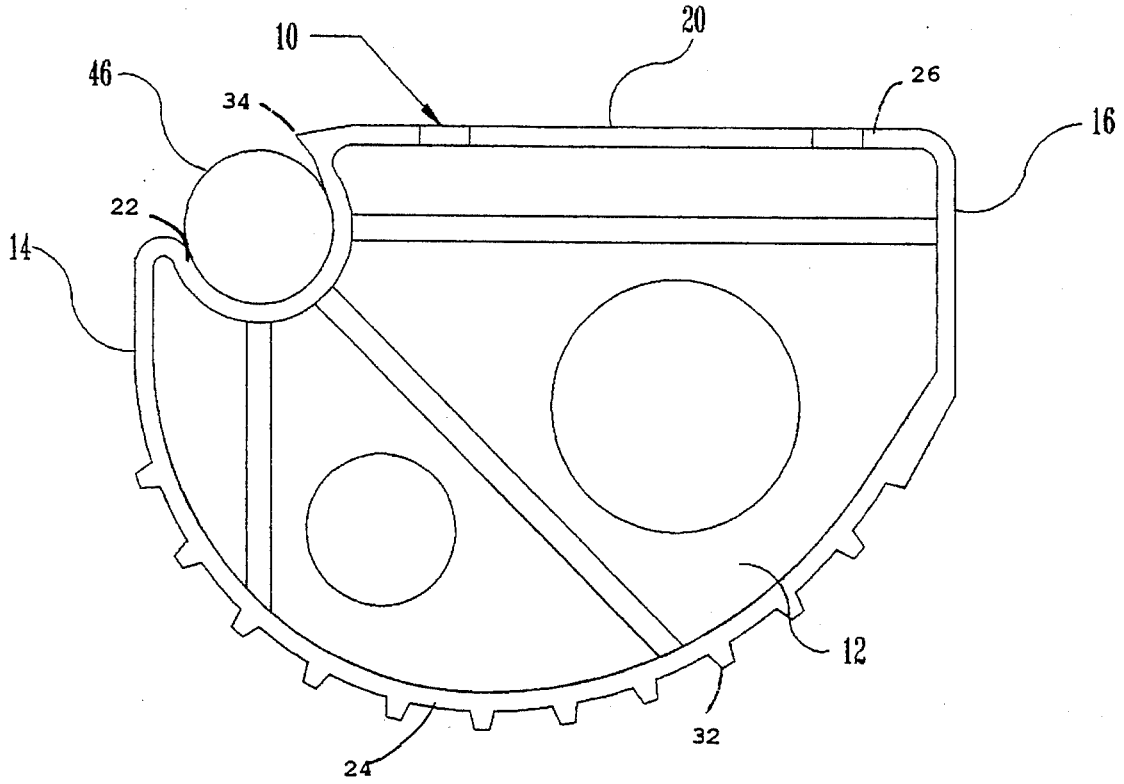
FIG. 1 is a front view of the first embodiment of the jack of the present invention placed under an axle prior to elevating the vehicle.
Figure 2:
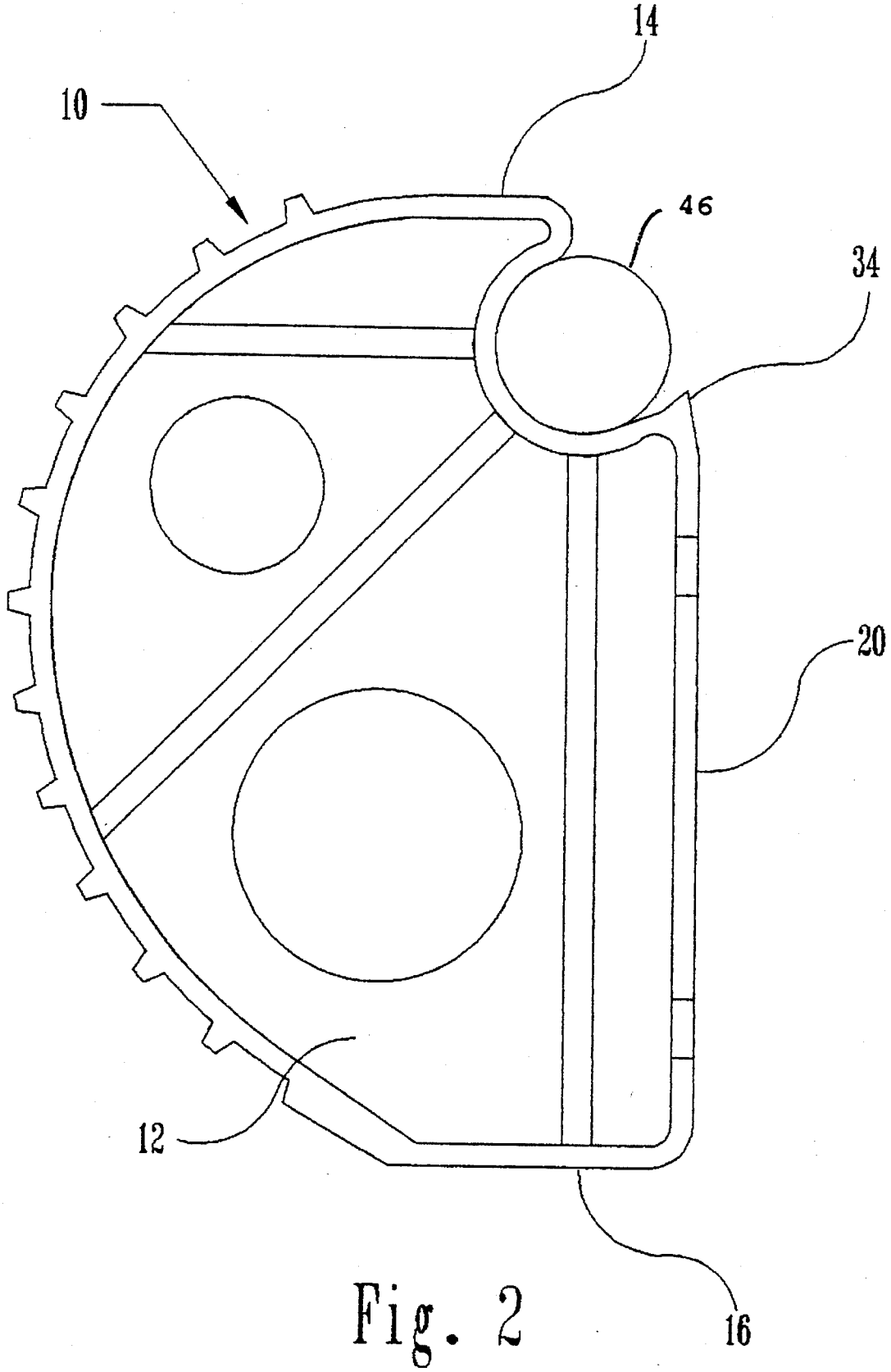
FIG. 2 is a front view of the first embodiment of the jack of the present invention placed under an axle following the elevation of the vehicle.
Figure 3:
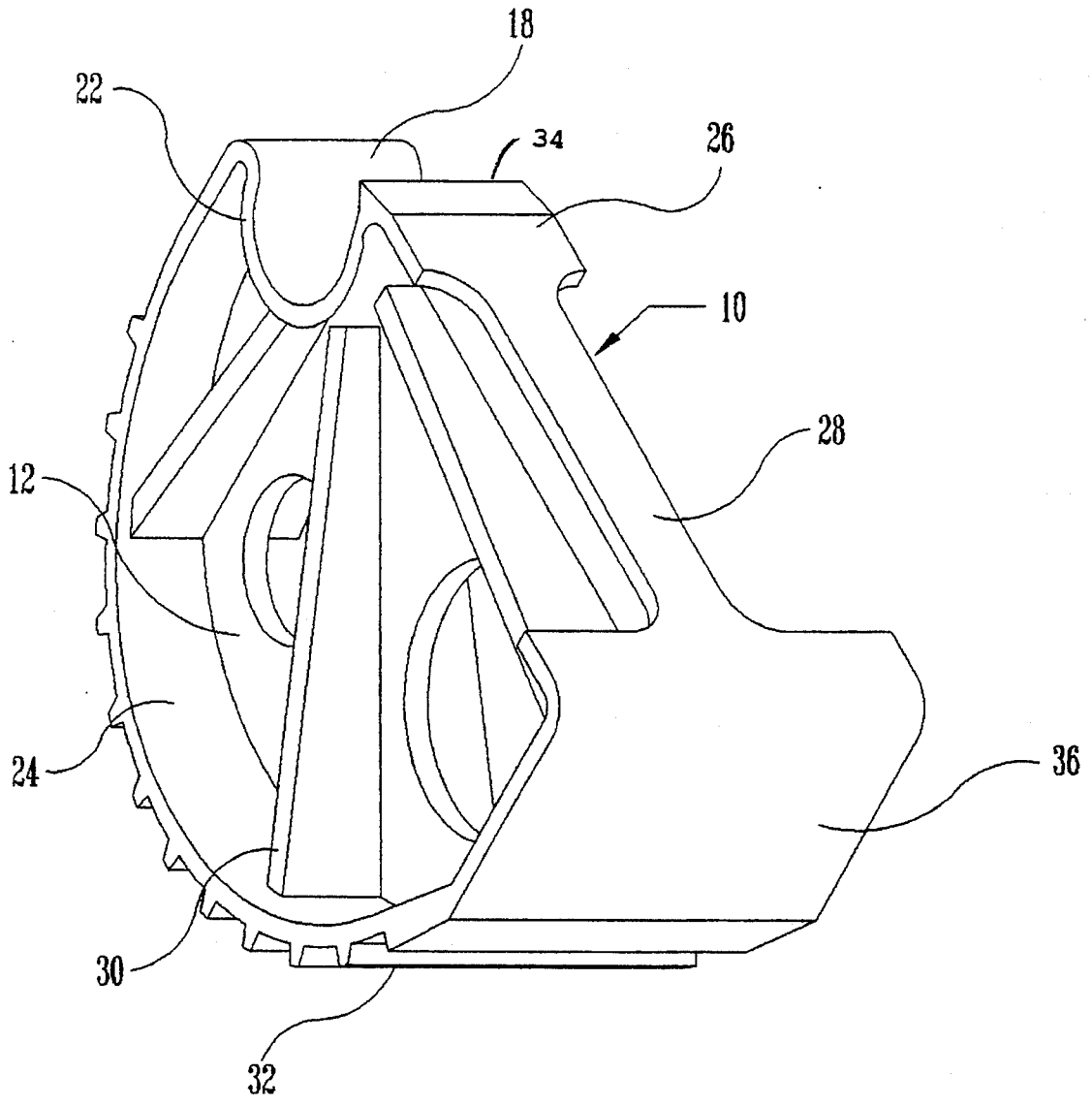
FIG. 3 is a perspective view of the first embodiment of the jack of the present invention.

FIGS. 1–3 illustrate the first embodiment of the present invention. As illustrated in theses figures, the jack 10 is unitized and consists of an arcuate base 12 having a first end 14 and a second end 16. A first semi-circular pivot 18 extends downwardly from the first end 14 of the arcuate base. This first semi-circular pivot 18 has two distal points to permit for one point to be attached to the first end 14 of the arcuate base 12 while the second distal point engages a straight edge 20. This straight edge 20 is located between the second end 16 of the arcuate base 12 and the second distal point of the semi-circular pivot 18. This second distal point also includes a stop 34 that extends upwardly from the semi-circular pivot point. This will provide for a means of maintaining and securing the axle 46 of a conventional vehicle within the pivot point. Hence, the semi-circular pivot 18 and the stop 34 provide for a receiving and maintaining means for the axle of the vehicle.

Located on the periphery of and extending perpendicularly from the first semicircular pivot 18 is a first flange 22. Located on the periphery of and extending perpendicularly from the base 12 is a second flange 24. Located on the periphery of and extending perpendicularly from the straight edge is a third flanged 26.

The second flange 24 increases in width from the first end 14 to the second end 16. This arrangement will provide for the second end to have an increased surface area. This will provide for the first end 14 to be a smaller width than the second end 16. This increase in width of the second end 16 of the second flange 24 will increase the stability of the vehicle trailer once the jack 10 is utilized or in an upright position (see FIG. 2).

The width of the first flange 22 is equal to width as the second flange 24 at the first end 14. The center area of the third flange 26 decreases in width to provide for the third flange to include a handle 28.

Extending from the lower surface of the first flange 22 of the jack to the upper surface of the second flange 24 are a plurality of supports 30. These supports 30 add strength to the jack 10 so as to permit for jack to maintain the weight of the trailer vehicle. Hence, as illustrated, the supports 30 extend downwardly from the first semi-circular pivot 18 to the upper surface of the second flange 22.

Located on the lower surface of the first flange is an anti-skid means 32. As illustrated in FIGS. 1–3, the anti-skid means 32 consists of a plurality of evenly spaced bars that extend horizontally across the second flange 24. It is noted that the anti-skid means can also consists of cleats (not illustrated) to enable the jack to work efficiently in sand or mud.

To assists in the stopping of the device, the second end 16 of the base 12 is flat. This will provide for the second flange 22 to extend outward and also be plane. This will provide for the second end 16 of the base 12 in combination with the extended and wider flange to act as a stop or stopping means 36. This stop or stopping means 36 provides stability when the vehicle is elevated.

In order to utilize the jack 10 of the first embodiment of the present invention, the semi-circular pivot 18 receives the axle 46 of a conventional vehicle. The position of the semi-circular pivot 18 is such that it is at its lowest position from the ground. This is such that the edge 20 is horizontal from the ground and that the stop or stopping means 36 is not in contact with the ground. The anti-skidding means 32 will be contacting the ground. This position is illustrated in FIG. 1.

Once the axle 46 is in place, the vehicle is moved forward to provide for the jack 10 to move forward. This forward motion will provide for the jack to inherently be lifted by increasing the distance between the semi-circular pivot 18 and the ground. The jack 10 will be in a stable and lifted position once the stopping means 36 is in contact with the ground. This position is illustrated in FIG. 2.

Figure 4:
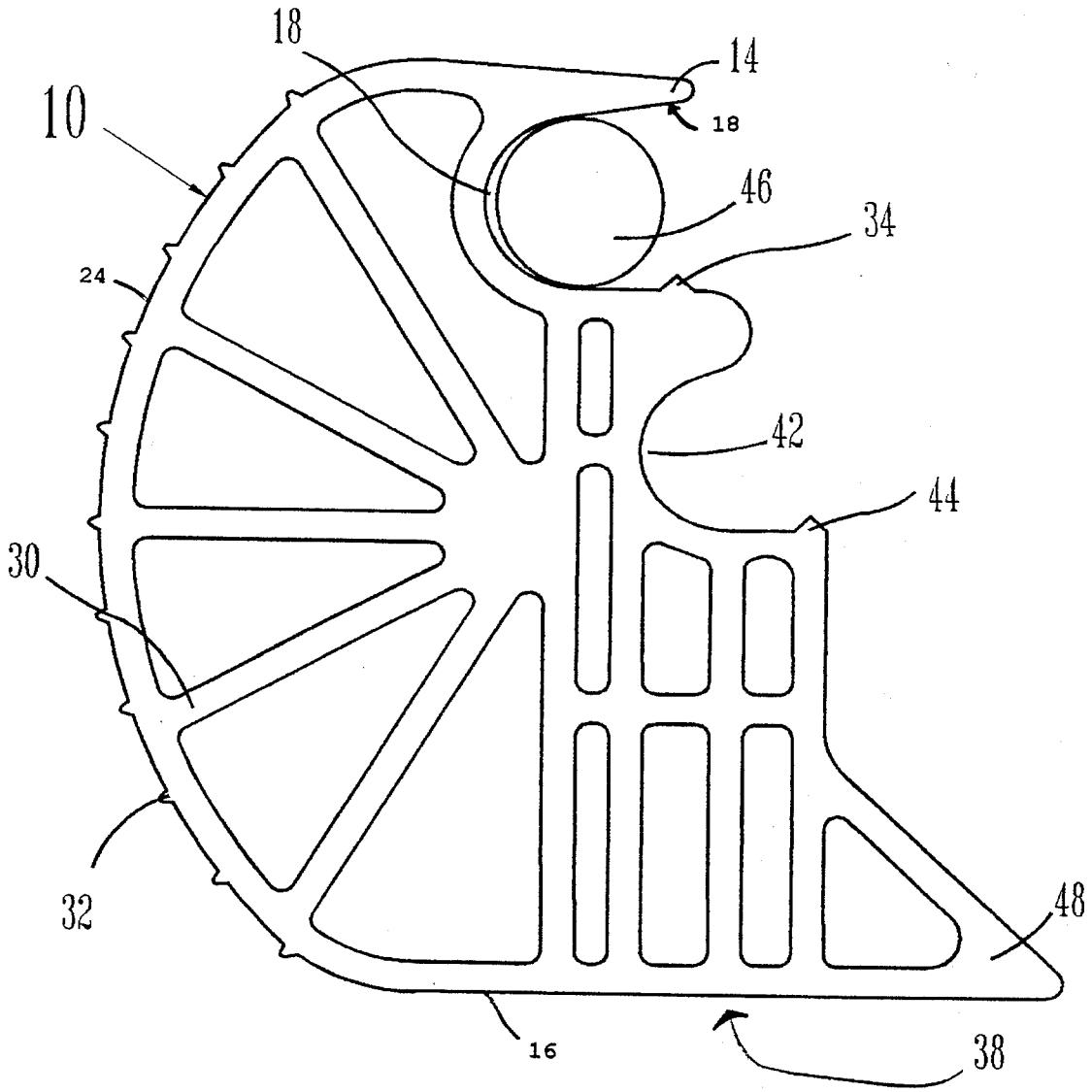
FIG. 4 is a side view of a second embodiment of the jack of the present invention.
Figure 5:
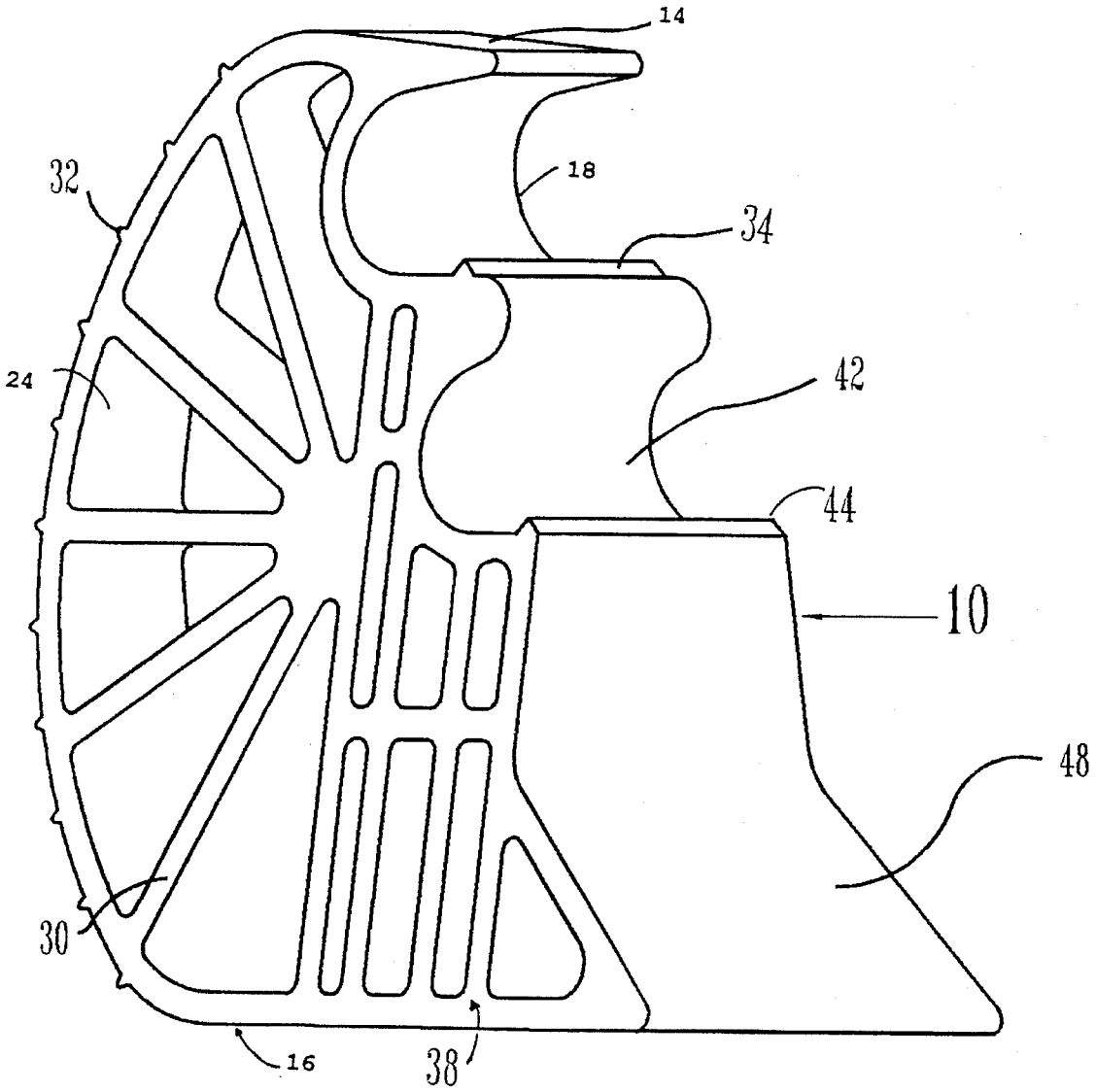
FIG. 5 is a perspective view of the second embodiment of the jack of the present invention.

The above described embodiment can be altered to include an accommodations of different size tires. In order to provide for this accommodation the jack is provided with a second semi-circular pivot point. This second embodiment is illustrated in FIGS. 4 and 5. As seen in these figures the second embodiment of the jack 10 includes an arcuate or curved flange base 24 having a first end 14 and a second end 16. The second end 16 of the arcuate flange base 24 is flat. Located at the first end 14 is a first semi-circular pivot 18. This first semi-circular pivot 18 has two distal points to permit for one point to be attached to the first end 14 of the arcuate flange base 24 while the second distal point engages a second semi-circular pivot 42. This will provide for the second semi-circular pivot 42 to be located downward from the first semi-circular pivot 18. This second semi-circular pivot 42 also includes two distal points to provide for the first distal point of the second semi-circular pivot 42 to contact the second distal point of the first semi-circular pivot 18. The first and second semi-circular pivots 18 and 42 are designed so as to accommodate wheels of various diameters.

Each second distal end of the first and second semi-circular pivots 18 and 42 includes stops 34 and 44 respectively. These stops extend upwardly from the semi-circular pivot point. Each stop will provide for a means of maintaining and securing the axle 46 of a conventional vehicle within the pivot point. Hence the combination of the semi-circular pivots and the stops provide a receiving means and a maintaining means for an axle of a conventional vehicle.

A stop 38 is located between the second distal end of the second semi-circular pivot 42 and the second end 16 of the flange base 24. This stop 38 adds to the length of the flat end or second end of the arcuate flange base 24. For added stability, an extension 48 extends outwardly from the stop 38. The combination of the stop and the extension provides a stability means for the jack when the vehicle is in a lifted position. This extension 48 will also act as a safety measure, so as to inherently stop the vehicle and jack from moving forward when the vehicle has reached its highest elevated point.

It is noted that the first end 14 of the base and the second end 16 of the base can optionally increase in width. This will provide for first end 14 to be a thinner width than that of the width of the second end of the base. The width of the second end 14 of the flange base 24 will be equal to the width of the stop 38 and/or extension 48. In this embodiment, the first end 14 of the flange base 24 and the second end 16 of the flange base 24 can optionally be equal in width. The stop 38 or the combination of the stop and extension 48 will be adequate for the stability of the jack once the vehicle is lifted.

Located on the lower surface of the base 24 is an anti-skid means 32. The anti-skid means 32 consists of a plurality of evenly spaced bars that extend horizontally across the base. It is noted that the anti-skid means can also consists of cleats (not illustrated) to enable the jack to work efficiently in sand or mud.

Extending from the second semi-circular pivot 42 to the top surface of the flange base 24 are a plurality of supports 30. These supports are designed and configured so as to optimize the structural integrity of the jack.

In order to utilize the second embodiment of the jack of the present invention, the axle of a conventional vehicle is placed in the appropriate semi-circular pivot. The axle will be at the lowest position from the ground. Once the axle 46 is secured within the semi-circular pivot, the vehicle is moved forward to provide for the jack 10 to move forward. This forward motion will provide for the jack to inherently be lifted by increasing the distance between the semi-circular pivot and the ground. The jack 10 will be in a stable and lifted position once the stopping means 36 is in contact with the ground.

The jack 10 of the first and second embodiments of the present invention can be fabricated from any durable material, such as plastic or metal. The structure of the jack is such that it is unibody, hence providing for an integral device.

While the invention has been particularly shown and described with reference to an embodiment thereof, it will be understood by those skilled in the art that various changes in form and detail may be made without departing from the spirit and scope of the invention.

I claim:

1. A jack to be used to lift a vehicle off a ground comprising:

an arcuate base having a first end and a second end;
said second end includes a flat surface;

a first semi-circular pivot engages said first end;
said semi-circular pivot includes a first distal point and a second distal point;
said first distal point contacts said first end of said arcuate base;

a straight edge extends from said distal end of said semi-circular pivot to said second end of said base;

a first flange extends perpendicularly from said first semi-circular pivot, a second flange extends perpendicularly from said arcuate base, and a third flange extends perpendicularly from said straight edge;
said second flange increases in width from said first end of said base to said second end of said base; and a plurality of supports extend from a lower surface of said first flange to an upper surface of said second flange.

2. A jack as in claim 1 wherein said second flange further includes anti-skidding means located on a lower surface of said second flange.

3. A jack as in claim 1 wherein said second distal end of said semi-circular pivot includes a stop that extends upwardly from said second distal end.

4. A jack to be used to lift a vehicle off a ground comprising:

an arcuate flange base having a top surface and a lower surface;
said width of said arcuate flange base increases in size from said first end to said second end of said arcuate base;
said arcuate flange base has a first end and a second end and said second end of said arcuate flange base is flat;

a receiving means for receiving a conventional axle of a vehicle is located at said second end of said base;
said receiving means includes an accommodating means for accommodating wheels of different diameters;

a plurality of supports extend from said receiving means to said top surface of said base; and said base, said receiving means, said accommodating means, and said support are integral.

5. A jack as in claim 4 wherein a first semi-circular pivot and a second semi-circular pivot form said receiving means and said accommodating means;
said first semi-circular pivot and said second semi-circular pivot each includes a first distal end and a second distal end;
said first distal end of said first semi-circular pivot is attached to said first end of said arcuate flange base and said second distal end of said first semi-circular pivot is attached to said first distal point of said second semi-circular pivot; and a stop extends from said second semi-circular pivot and said second end of said arcuate flange base.

6. A jack as in claim 4 wherein said lower surface includes an anti-skidding means.

7. A jack as in claim 5 wherein said second distal end of said first semi-circular pivot includes a first stop that extends upwardly and said second distal end of said second semi-circular pivot includes a second stop that extends upwardly.

8. A jack as in claim 5 wherein an extension is secured to said stop and extends outwardly from said stop.

9. A jack to be used to lift a vehicle off a ground comprising:

an arcuate flange base having a top surface and a lower surface;
said arcuate flange base has a first end and a second end and said second end of said arcuate flange base is flat;

a receiving means for receiving a conventional axle of a vehicle is located at said second end of said arcuate flange base;
said receiving means includes an accommodating means of accommodating wheels of different diameters;

a plurality of supports extend from said receiving means to said top surface of said base;

a first semi-circular pivot and a second semi-circular pivot form said receiving means and said accommodating means;

said first semi-circular pivot and said second semi-circular pivot each includes a first distal end and a second distal end;

said first distal end of said first semi-circular pivot is attached to said first end of said arcuate flange base and said second distal end of said first semi-circular pivot is attached to said first distal point of said second semi-circular pivot; and said arcuate flange base, said receiving means, said accommodating means, and said support are integral.

10. A jack as in claim 9 wherein a stop extends from said second semi-circular pivot and said second end of said arcuate flange base.

11. A jack as in claim 10 wherein said lower surface of said arcuate flange base includes an anti-skidding means.

12. A jack as in claim 10 wherein said second distal end of said first semi-circular pivot includes a first stop that extends upwardly and said second distal end of said second semi-circular pivot includes a second stop that extends upwardly.

13. A jack as in claim 10 wherein extension is secured to said stop and extends outwardly from said stop.

* * * * *